US010918923B1

(12) United States Patent
Musser et al.

(10) Patent No.: US 10,918,923 B1
(45) Date of Patent: Feb. 16, 2021

(54) FLOATING TOSSING GAME

(71) Applicant: MUSSER'S INC., Quarryville, PA (US)

(72) Inventors: Brent Musser, New Providence, PA (US); Brian Musser, Holtwood, PA (US); Michael Robert Musser, Lancaster, PA (US); Michael John Musser, Columbia, PA (US)

(73) Assignee: MUSSER'S INC., Quarryville, PA (US)

( * ) Notice: Subject to any disclaimer, the term of this patent is extended or adjusted under 35 U.S.C. 154(b) by 0 days.

(21) Appl. No.: 16/739,301

(22) Filed: Jan. 10, 2020

(51) Int. Cl.
*A63B 67/00* (2006.01)
*A63B 67/06* (2006.01)

(52) U.S. Cl.
CPC ..... *A63B 67/007* (2013.01); *A63B 67/06* (2013.01); *A63B 2067/061* (2013.01); *A63B 2208/03* (2013.01); *A63B 2225/605* (2013.01)

(58) Field of Classification Search
CPC . A63B 2225/605; A63B 67/007; A63B 67/06; A63B 2067/061; A63B 2208/03
See application file for complete search history.

(56) References Cited

U.S. PATENT DOCUMENTS 2,744,752 A * 5/1956 Arnold ..... A63B 67/06 273/398
3,095,197 A * 6/1963 Weitzman ..... A63B 69/12 273/350
3,104,879 A * 9/1963 Jetton ..... A63B 57/40 473/153
3,403,907 A * 10/1968 Keller ..... A63F 9/0243 273/350
3,509,584 A * 5/1970 Sable ..... A61H 33/6052 472/128
3,731,930 A * 5/1973 Jeandron ..... A63F 9/0204 273/395
3,740,036 A * 6/1973 Ames ..... A63B 43/00 473/569
3,784,200 A * 1/1974 Hotchkiss ..... A63F 9/02 273/409
3,814,439 A * 6/1974 Simon ..... A63B 57/40 473/196
3,895,801 A * 7/1975 Baird ..... A63B 63/00 273/350
4,212,460 A * 7/1980 Kraft ..... A63B 65/00 273/127 A (Continued)

*Primary Examiner* — Melba Bumgarner
*Assistant Examiner* — Amir A Klayman
(74) *Attorney, Agent, or Firm* — McNees Wallace & Nurick LLC

(57) ABSTRACT

A tossing game includes placing two floating goals spaced apart in a body of water, each goal defining a scoring region. The participants add an amount of water to cups and toss the cups in the direction of one of the goals for at least two turns, with the participants awarded points in response to the cups being tossed into the scoring region. Each filling of the cup during a participant's turn adds variability to the game, challenging the participants to determine a suitable amount of water to be placed in the cup for their own throwing technique as well as to repeatedly add approximately the same amount of water on subsequent turns once the participants have determined the fill level that best suits them.

11 Claims, 6 Drawing Sheets

(56) References Cited

U.S. PATENT DOCUMENTS 4,906,006 A * 3/1990 Sigunick ..... A63B 57/357 473/185
4,909,518 A * 3/1990 Erlandson ..... A63F 9/02 124/17
4,938,485 A * 7/1990 Hockridge ..... A63F 9/02 273/354
4,986,549 A * 1/1991 Kuhtic ..... A63B 67/06 273/402
5,056,796 A * 10/1991 Conville ..... A63B 67/06 273/402
5,056,797 A * 10/1991 Hockert ..... A63B 67/06 273/402
5,060,955 A * 10/1991 Bible ..... A63B 67/06 273/400
5,141,441 A * 8/1992 Wallingford ..... A63B 69/12 434/254
5,199,708 A * 4/1993 Lucas ..... A63B 67/06 273/108
5,427,084 A * 6/1995 Arnold ..... F41B 3/00 124/4
5,615,887 A * 4/1997 Park ..... A63F 9/0098 273/272
5,732,952 A * 3/1998 Joseph ..... A63B 63/08 273/317.6
5,776,004 A * 7/1998 Wilson ..... A63B 57/357 473/179
5,975,983 A * 11/1999 Panec ..... A63H 37/00 141/114
6,004,219 A * 12/1999 Peabody ..... A63B 67/02 473/157
6,030,300 A 2/2000 Zheng
6,161,833 A * 12/2000 Gomez ..... A63B 67/06 273/400
6,173,957 B1 * 1/2001 James, Sr. ..... A63B 63/08 273/350
6,264,573 B1 7/2001 Zheng
6,299,172 B1 10/2001 McMurray
6,461,257 B2 10/2002 Zheng
6,520,874 B2 2/2003 Beazley
6,736,740 B2 5/2004 Zheng
6,761,563 B1 * 7/2004 Lin ..... G09B 5/062 273/153 R
6,899,647 B2 5/2005 Chia
7,048,654 B2 5/2006 Zheng
7,267,625 B2 9/2007 Zheng
7,360,767 B2 * 4/2008 Merccica ..... A63B 67/06 273/350
7,464,937 B1 12/2008 Maggio
7,682,268 B2 3/2010 Zheng
7,775,915 B2 * 8/2010 McCarthy ..... A63B 24/0021 273/350
8,376,871 B1 * 2/2013 Cloud ..... A63B 67/02 473/163
8,403,778 B2 * 3/2013 Wallach ..... A63B 43/002 473/613
8,454,459 B1 * 6/2013 Reed ..... A63B 67/10 273/343
8,764,017 B2 7/2014 Manner et al.
8,814,716 B2 * 8/2014 Pennington ..... A63B 69/3661 473/278
9,124,196 B1 9/2015 Honein et al.
9,248,357 B2 2/2016 Francis
9,358,439 B2 6/2016 Manner et al.
9,415,292 B2 * 8/2016 Reino ..... A63B 57/00
9,421,443 B2 8/2016 Boyer et al.
9,555,301 B2 1/2017 Rieman
9,724,579 B1 * 8/2017 Allen ..... A63B 63/00
9,789,387 B2 10/2017 Shea
9,808,689 B1 11/2017 Siepmann
9,827,474 B2 11/2017 Sciandra
9,962,587 B2 5/2018 Siepmann
9,987,538 B1 * 6/2018 Crosby ..... A63B 71/023
10,238,957 B2 * 3/2019 Rodems ..... A63F 9/001
10,378,850 B1 * 8/2019 Young ..... A63H 33/18
10,493,328 B1 * 12/2019 Depcik ..... A63F 9/001
10,518,155 B2 12/2019 Portnoff et al.
10,556,154 B1 * 2/2020 Maresh ..... A63B 23/03525
2002/0098899 A1 * 7/2002 Newcomb ..... A63B 67/02 473/157
2004/0108658 A1 * 6/2004 Bartel ..... A63B 67/06 273/398
2004/0178584 A1 * 9/2004 Fairbanks ..... A63B 67/06 273/400
2004/0221885 A1 11/2004 Zheng
2006/0022409 A1 2/2006 Zimmerman
2006/0066054 A1 * 3/2006 Menendez ..... A63B 67/06 273/348
2006/0066055 A1 * 3/2006 Menendez ..... A63B 67/06 273/398
2006/0247072 A1 * 11/2006 Combs ..... A63B 67/007 473/348
2008/0143052 A1 6/2008 Paslawski
2009/0081919 A1 3/2009 Zheng
2009/0194941 A1 8/2009 Boyd et al.
2011/0278796 A1 11/2011 Baculy
2012/0049458 A1 3/2012 Yokie
2012/0289118 A1 11/2012 Ohm et al.
2013/0093139 A1 4/2013 Shea
2014/0011603 A1 * 1/2014 Pennington ..... A63B 69/3661 473/278
2014/0333026 A1 * 11/2014 Hynds ..... A63B 67/06 273/354
2015/0061225 A1 3/2015 Sciandra
2015/0137452 A1 * 5/2015 Dahl ..... A63F 7/0017 273/342
2015/0217903 A1 * 8/2015 Mazyck, III ..... E04D 15/07 220/4.01
2016/0045818 A1 2/2016 Medway
2017/0319929 A1 11/2017 Sciandra
2017/0354855 A1 12/2017 Cullen et al.
2018/0001171 A1 1/2018 Zavracky
2018/0050261 A1 2/2018 Shea
2018/0154233 A1 * 6/2018 Mueller ..... A63B 67/06
2018/0221740 A1 8/2018 Richwagen
2018/0333624 A1 11/2018 Wilson
2019/0134476 A1 5/2019 Spady
2019/0184253 A1 6/2019 Silva et al.
2019/0308082 A1 * 10/2019 Hudgins ..... A63B 67/066
2020/0316446 A1 * 10/2020 Marino ..... A63B 71/0036

* cited by examiner

FLOATING TOSSING GAME

FIELD

The present invention is directed to tossing games. More specifically, the present invention is directed to tossing games generally played in bodies of water.

BACKGROUND

Most skill based tossing games, such as cornhole, horseshoes or lawn darts, are played on land and designed to be very predictable. Furthermore, skill based tossing games for swimming pools typically require a large organized team of participants, such as water polo. These games also generally require large equipment, such as goal nets, that require significant storage space when not in use.

It would be desirable to have a game that a small group can play in a backyard pool or other body of water that provides increased variability in game play, does not require a large team, and does not require significant storage space when not being played.

SUMMARY

Exemplary embodiments are directed to a skill based tossing game using a floating game board and container to be tossed that requires the participant to add the weight, which can be selected by the participant, adding an increased element of skill and variability to the game play.

In an exemplary embodiment, a method of playing a game includes placing a goal in a body of water, the goal being constructed of a buoyant material and defining a scoring region. The method additionally includes, adding, by a first participant, an amount of water to a first cup. The method additionally includes tossing, by the first participant, the first cup containing the amount of water in the direction of the goal. The method additionally includes, adding, by a second participant, an amount of water to a second cup. The method additionally includes, tossing, by the second participant, the second cup containing the amount of water in the direction of the goal. The method additionally includes repeating the steps of adding and tossing by each of the first and second participants and awarding points to the first and second participants in response to the first and second cups, respectively, being tossed into the scoring region.

In another exemplary embodiment, a game kit includes a buoyant structure having a first face, a second face, a length, a width, a thickness, an internal region defining a space extending from the first face to the second face, and a border dimension between an external edge and the internal region. The buoyant structure is formed from a material exhibiting buoyancy in water and the sheet structure forms a goal of the game. The game also includes a cup.

Other features and advantages of the present invention will be apparent from the following more detailed description of the preferred embodiment which illustrates, by way of example, the principles of the invention.

BRIEF DESCRIPTION OF THE DRAWINGS

Wherever possible, the same reference numbers will be used throughout the drawings to represent the same parts.

DETAILED DESCRIPTION

To address the shortcomings in the art, provided herein is a game which can be played by a small group of people in a swimming pool or other body of water. The present invention includes game pieces used in playing the game and rules for the game.

Figure 1:
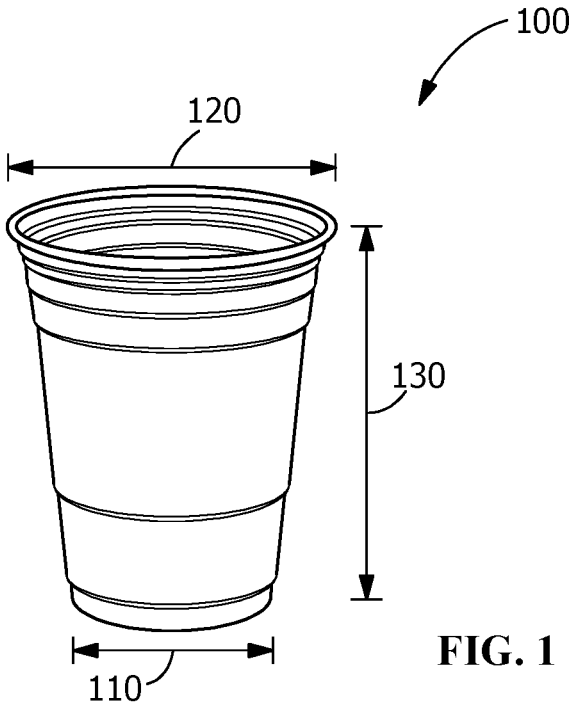
FIG. 1 illustrates a cup, according to an embodiment.

The game pieces include at least one cup 100, shown in FIG. 1. The at least cup 100 may include a plurality of cups 100. The cups 100 may be colored and used to represent one or more of the participants or teams participating in the game. In one embodiment, a plurality of cups 100 of a first color and a plurality of cups 100 of a second color are provided to represent a first participant or team and a second participant or team, respectively. In some embodiments, the cups 100 are shaped like standard drinking cups, being substantially conical in shape; the cups 100 may be configured to have a container volume (i.e., to hold when filled) from about 3 fluid ounces (about 88 milliliters) to about 24 fluid ounces (about 710 milliliters). In some embodiments, the cups 100 are configured to have a container volume from about 5 fluid ounces (about 147 milliliters) to about 24 fluid ounces (about 710 milliliters). Typically, the cups 100 are configured to have a container volume from about 12 fluid ounces (about 350 milliliters) to about 24 fluid ounces (about 710 milliliters). In one embodiment, the cups 100 include a 20 fluid ounce cup 100. In some embodiments, the cups 100 are formed of plastic. In one embodiment, suitable cups 100 may include flexible plastic party cups, such as those sold under the trademark SOLO. While depicted herein primarily with respect to drinking cups, the term "cup" is intended to capture any fillable container to which a liquid can be added and tossed in the manner described, including bottles, bowls, etc.

In some embodiments, the cups 100 may be configured to exhibit a base diameter 110 of about 1.5 inches (about 37 millimeters) to about 3 inches (about 75 millimeters). In one embodiment, the cups 100 exhibit a base diameter 110 of about 2 inches (about 50 millimeters) to about 3 inches (about 75 millimeters). Typically, the cups 100 exhibit a base diameter 110 of about 2.5 inches (about 68 millimeters).

In some embodiments, the cups 100 may be configured to exhibit a top diameter 120 of about 2.37 inches (about 60 millimeters) to about 4.5 inches (about 115 millimeters).

Typically, the cups 100 are configured to exhibit a top diameter 120 of about 3.75 inches (about 95 millimeters) to about 4.5 inches (about 115 millimeters). In one embodiment, the cups 100 exhibit a top diameter 110 of about 3.875 inches (about 100 millimeters).

In some embodiments, the cups 100 may be configured to exhibit a height 130 of about 2.25 inches (about 63 millimeters) to about 7 inches (about 180 millimeters). Typically, the cups 100 are configured to exhibit a height 130 of about 3.75 inches (about 95 millimeters) to about 7 inches (about 180 millimeters). In one embodiment, the cups 100 exhibit a height 130 of about 5.75 inches (about 150 millimeters).

Figure 2A:
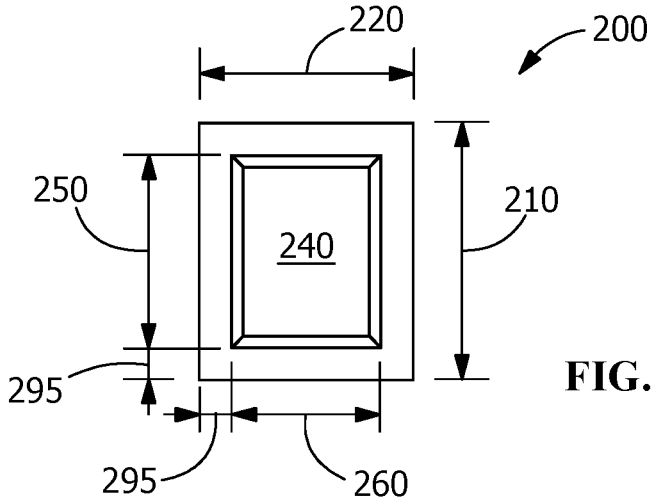
FIG. 2A is a top view of a goal of the game, according to an embodiment.
Figure 2B:
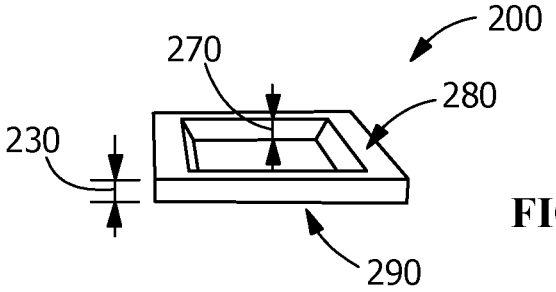
FIG. 2B is a perspective view of the goal of FIG. 2A.

The game pieces additionally include at least one goal 200 shown as a top view in FIG. 2A and as a perspective side view in FIG. 2B. The at least one goal 200 is formed from a material which allows the goal 200 to exhibit buoyancy in water. In some embodiments, the goal 200 is formed of an expanded polymer, such as a foam material. In one embodiment, the goal 200 includes polystyrene. In one embodiment, the goal 200 includes closed-cell polystyrene foam.

The at least one goal 200 may be formed as one or more geometric shapes. Suitable shapes include but are not limited to square, rectangular, circular, elliptical, oval, and combinations thereof. In the example of FIGS. 2A and 2B the goal 200 exhibits a rectangular profile.

In the example of FIGS. 2A and 2B, the goal 200 is formed from a sheet structure having a first face 204, second face 206, length 210, width 220, and thickness 230. An internal region 240 is present in the goal 200 that may define a scoring region as will be described subsequently in further detail with respect to the gameplay. The internal region 240 may be formed by removing a portion of the sheet structure from the goal 200 so that the goal 200 has an outer frame portion that defines the open internal region 240 that serves as the scoring region. The internal region 240 has an internal length 250, internal width 260, and internal thickness 270. In the example of FIGS. 2A and 2B, the internal region 240 was formed at a non-right angle with top face 280 and bottom face 290. Thus, in the example of FIGS. 2A and 2B, the internal length 250 and internal width 260 may optionally vary in the thickness direction 270 providing a taper, in some cases angled at about 45 degrees, although it could be higher or lower and in some embodiments, no taper may present, with the internal region being formed at a right angle with the top and bottom faces. In some embodiments, the length 210 may be about 18 inches to about 30 inches, the width 220 may be about 16 inches to about 24 inches, the thickness 230 may be about 1 inch to about 6 inches and combinations of ranges and subranges thereof. In one embodiment, the length 210 may be about 19.2 inches, the width 220 may be about 24 inches, and thickness 230 may be about 4 inches. In some embodiments, the goal border dimension 295 may be between about 1 inch to about 6 inches and combinations of ranges and subranges thereof. In one embodiment, the goal border dimension 295 may be about 4 inches.

Figure 3:
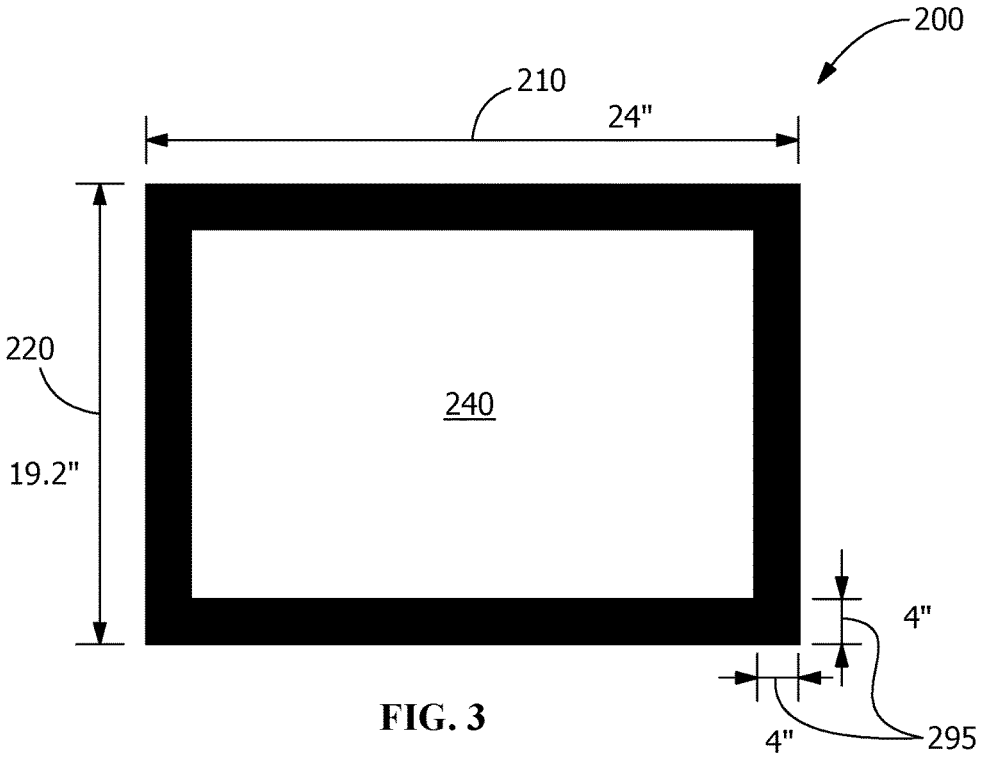
FIG. 3 illustrates an embodiment of a goal, according to an embodiment.

FIG. 3 illustrates an example of the goal 200. The goal 200 exhibits a length 210 of about (i.e., + or −1 inch) 24 inches, a width 220 of about 19.2 inches, and a goal border dimension 295 of about 4 inches.

The goal 200 may optionally additionally include one or more inserts positioned within the internal space 240 of the goal 200. The inserts can advantageously be formed from the material initially removed to create the internal space 240 and can be held in place during use as a result of the tapered internal sides of the goal 200.

Figure 4A:
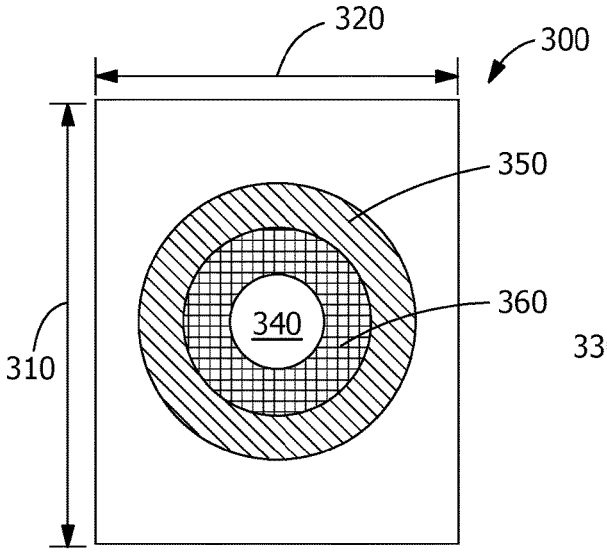
FIG. 4A is a top view of an insert, according to an embodiment.
Figure 4B:
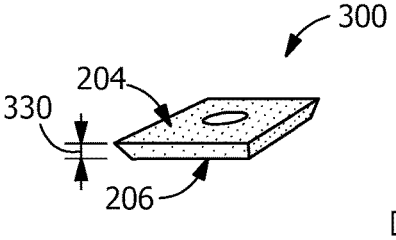
FIG. 4B is a perspective view of the insert of FIG. 4A.
Figure 4C:
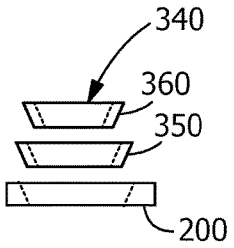
FIG. 4C is an exploded side view of the insert of FIG. 4A.

An example of an insert 300 is shown as a top view in FIGS. 4A-4C. The one or more inserts 300 may be used to modify the shape and/or dimensions of the available space within the internal region 240 to serve as a scoring sub-region in which the balance of the scoring region that would otherwise be available has been filled in by the insert. In the example of FIGS. 4A and 4B, the insert has a length 310, width 320, and thickness 330. In some embodiments, the dimensions of the one or more inserts 300 may correspond to the dimensions of the internal region 240.

At least one insert internal region 340 forms an opening in in the insert, such as a depressed well or through-hole and which does not intersect an outer edge. The insert internal region 340 may be formed as one or more geometric shapes. Suitable shapes include but are not limited to square, rectangular, circular, elliptical, oval, and combinations thereof. In the example of FIGS. 4A and 4B the insert 300 exhibits a generally circular profile. For embodiments using an insert, the insert internal region 340 provides a smaller scoring region than if the goal 200 is used without the insert 300, thus forming a scoring sub-region of increased difficulty to achieve.

FIG. 4A, together with FIG. 4C, additionally illustrate optional sub-inserts 350 and 360 which may be added or removed to modify the shape and/or dimensions of the available space of the insert internal region 340. In some embodiments, the shape and dimensions of the insert internal region 340 may be selected to conform to the shape and/or dimensions of the base diameter 110 of the cup 100. In some embodiments, the insert internal region 340 may have a substantially circular cross-section. In some embodiments, the ratio of a diameter of the insert internal region 340 to the base diameter 110 of one or more cups 100 may be from about 2:1 to about 1:1. In some embodiments, the diameter of the insert internal region 340 may be configured to substantially correspond to the conical shape of the one or more cups 100 by tapering in the thickness direction 330.

Figure 5:
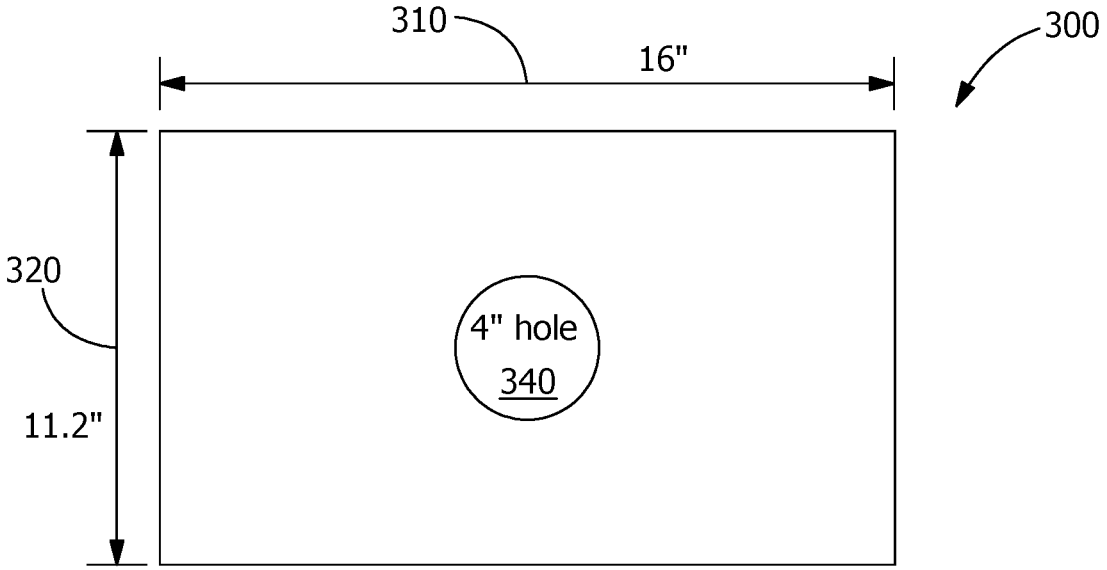
FIG. 5 illustrates an embodiment of an insert, according to an embodiment.

FIG. 5 illustrates an embodiment of the insert 300. The external dimensions of the insert 300 correspond to the dimensions of the internal region 240 of the goal 200 of FIG. 3. In the example of FIG. 5, the insert internal length 310 is about 16 inches and the insert internal width 320 is about 11.2 inches. The insert 300 additionally includes an insert internal region 340 having a dimeter of about 4 inches.

Figure 6A:
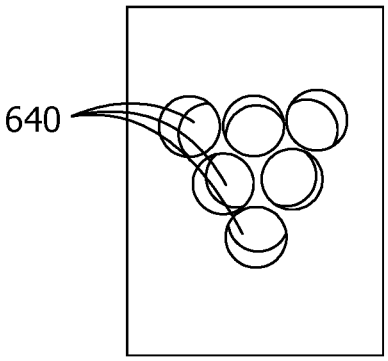
FIG. 6A illustrates a top view of an insert, according to an embodiment.
Figure 6B:
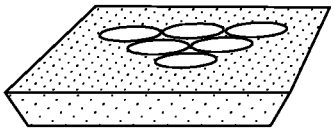
FIG. 6B illustrates a perspective view of the insert of FIG. 6A.

The game pieces described above allow numerous variations of the game, adding variability and differing challenge levels which are customizable by the participants. In some embodiments, a variety of different inserts may be provided and/or sold separately for use in conjunction with the same frame of the goal 200. For example, FIGS. 6A and 6B illustrate an alternate embodiment of an insert. In the example of FIGS. 6A and 6B, an insert 600 is shown as a top view in FIG. 6A and a perspective side view in FIG. 6B. The insert 600 includes a plurality of non-interconnected insert internal regions 640 that can serve as multiple separate scoring regions. The elements of insert 600 may otherwise be as described above for the insert of FIGS. 4A and 4B.

With respect to basic gameplay, initially, at least one goal 200 is provided and the participants separate into two teams, typically two players to a team. Typically, two goals 200 are provided, the goals being spaced apart from each other.

The tossing game includes a participant throwing a cup 100 towards one of the goals 200, in which some amount of water from the pool (or other body of water in which the game is being played) is added by the participant attempting to land the cup in a scoring region defined by the goal 200. The cups 100 are typically light and the act of filling it with water, generally in an amount of 25% or less of the total cup volume, provides the weight needed to toss the cup long distances, such as the twenty or more feet away that the goals are generally positioned.

Each filling of the cup 100 adds variability to the game. It is a challenge for the participants to determine a suitable amount of water to be placed in the cup 100 and advantageous amounts of water can change based on the cup size and distance to the goal. It is also a challenge to add approximately the same amount of water each time after the participant determines a suitable amount for his or her preference. This adds to both the challenge and replayablility of the game.

It will be appreciated that the amount of water to be added to the cup 100 is in each case selected by the participant throwing the cup such that the total weight being tossed is variable between subsequent throws and is not permanently fixed (and that the step of adding water may also include pouring out some amount of water if the participant determines he or she initially has more water in the cup than desired prior to tossing it). However, in some embodiments, the cup 100 may have visible markings to aid or direct a participant in filling the cup with water to an advantageous amount or within an advantageous range. In other embodiments, the cups are free of any markings so that the participant is unaided in independently selecting the amount of water, further increasing the need for skill on the part of the participant.

In one variation, the object is to land the cup 100 into the scoring region of a freely floating goal 200 while in another variation the object is to land the cup 100 into a smaller scoring region of the goal 200 (i.e., as scoring sub-region created through use of the insert 300), in which a participant's teammate is free to maneuver the goal 200 during flight of the cup 100 to compensate for the scoring region being made smaller, preferably while keeping the goal flat and in contact with the surface of the water. In a presently preferred embodiment, a winner is determined by a total score that is a combination of scoring from each of the first and second variations as part of the total gameplay.

Figure 7:
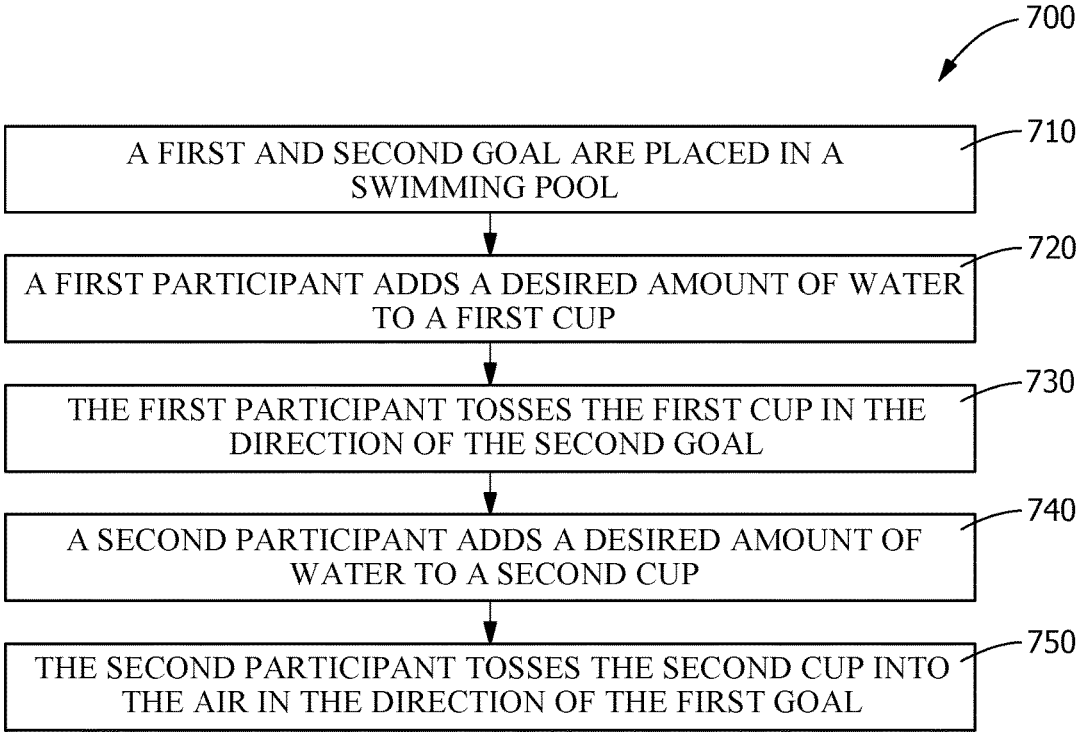
FIG. 7 is a block diagram of a method of playing the game, according to an embodiment.
Figure 8:
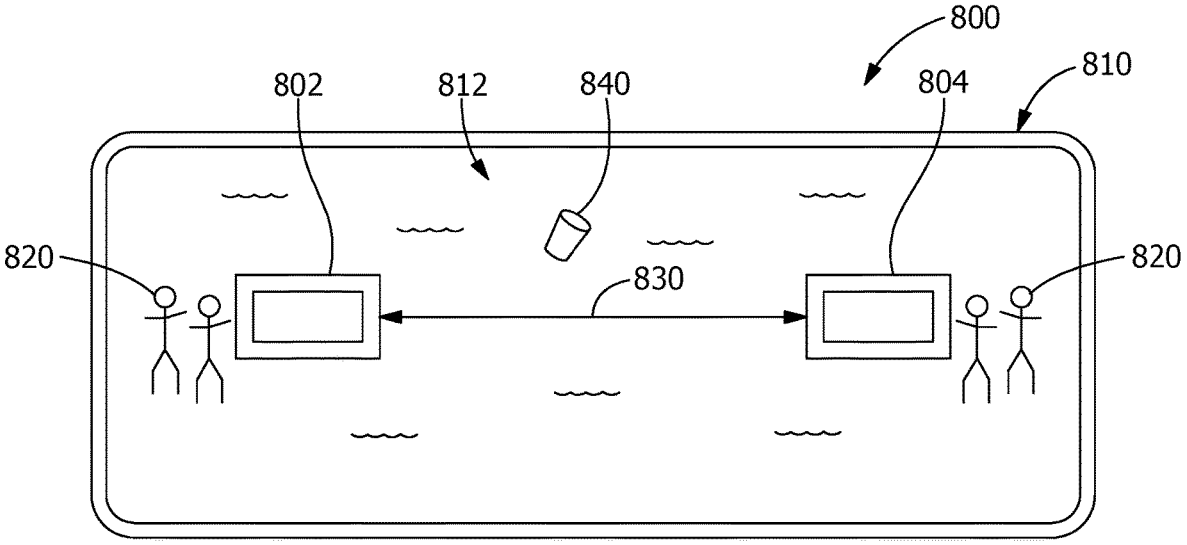
FIG. 8 is a diagram of the game being played, according to an embodiment.

One embodiment of a method of playing the game is described in FIG. 7 based on the diagram 800 of FIG. 8, which is typically played in a body of water. To aid in gameplay, the body of water should have little or no current and/or little or no wave action; the game can readily be played in a swimming pool as well as lakes, lagoons, and ponds, as well as slow moving rivers, for example.

At block 710, a first goal 802 and a second goal 804 are placed in a swimming pool 810. In some embodiments, the first goal 802 and second goal 804 may be the goal 200 as described in the description of FIG. 2 above. As shown, in this first variation, the first goal 802 and second goal 804 illustrated in the diagram 800 do not include any insert. Thus, the scoring region is defined by the entire internal space 240 of the goal 200. The swimming pool 810 shown in the example of FIG. 8 is rectangular and provides a depth of water 812 which allows one or more participants 820 to stand upright while in the swimming pool 810. The first goal 802 and the second goal 804 are spaced apart a distance 830 determined by the one or more participants 820.

Typically, the first goal 802 and the second goal 804 are spaced about 10 feet to about 35 feet apart. In general, the larger the cups 100 used, the greater the spacing that may be employed. Preferably, the first goal 802 and the second goal 804 are spaced about 18 feet to about 30 feet apart. In some embodiments, the first goal 802 and the second goal 804 are spaced apart a distance 830 of at least 10 feet, at least 11 feet, at least 12 feet, at least 13 feet, at least 14 feet, at least 15 feet, at least 16 feet, at least 17 feet, at least 18 feet, at least 19 feet, at least 20 feet, at least 21 feet, at least 22 feet, at least 23 feet, at least 24 feet, at least 25 feet, less than 35 feet, less than 34 feet, less than 33 feet, less than 32 feet, less than 31 feet, less than 30 feet, less than 29 feet, less than 28 feet, less than 27 feet, less than 26 feet, and combinations of ranges and subranges thereof.

At block 720, a first participant 820 adds a desired amount of water 812 to a first cup 840. The participant may fill any desired amount of water believed to be advantageous, although the water is generally in an amount of 25% or less of the total cup volume which provides the weight needed to toss the cup the appropriate distance to the goal. As previously noted, each filling of the cup 840 adds variability to the game and advantageous amounts of water can change based on the cup 840 size and distance between the goals 802, 804.

At block 730, the first participant 820 tosses the first cup 840 into the air in the direction of the second goal 804 attempting to cause the first cup 840 to splash down within a scoring region defined by the second goal 804. If the first participant 820 is successful in causing the first cup 840 to fall within the second goal 804, the first participant 820 and/or a first team scores, for example 1 point.

At block 740, a second participant 820, typically of an opposing team, takes a turn by substantially repeating the steps of the first participant 820. The second participant adds a desired amount of water 812 to a second cup 840. At block 750, the second participant 820 tosses the second cup 840 into the air in the direction of the first goal 802 attempting to cause the second cup 840 to splash down within the first goal 802. If the first participant 820 is successful in causing the second cup 840 to fall within the first goal 802 the second participant 820 and/or a second team scores, for example, one point. The above steps of blocks 730 and 750 may be repeated until one participant/team has accumulated a predetermined number of points or until a predetermined number of rounds has been completed. It will be appreciated that the first and second participants are typically the same individuals during successive tosses, but that depending on the number of players on a team, the first and second participants are not necessarily the same individuals during successive tosses. For example, the individual acting as the first participant for the initial toss of the first cup 840 may give way to a teammate to be the first participant that throws the first cup 840 during the next toss.

While the description of FIG. 7 exemplifies opposing team members alternating tosses in opposing directions, it is understood that both teams may toss in the same or different directions. The tosses by each team may alternate or may be ordered, typically symmetrically, as desired until one team accumulates the predetermined number of points or the total number of rounds has been accomplished. In the embodiment described above for FIG. 7, the goals 802 and 804 are typically not touched or moved by a participant 820 during gameplay and particularly during the period of time in which the cup 840 is in flight. It will be appreciated however, that the goals 802 and 804 may be moved between tosses or rounds to reset their position to offset the effects of, for example, wave action.

Figure 9:
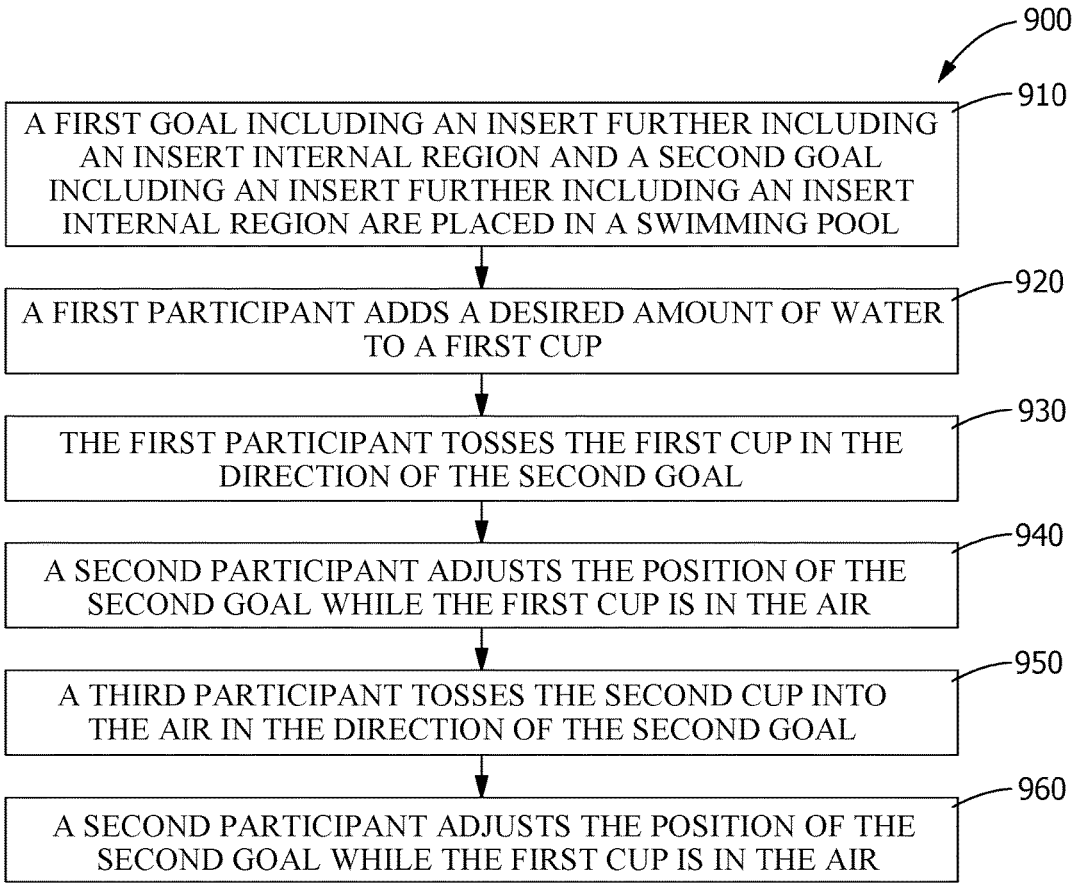
FIG. 9 is a block diagram of a method of playing the game, according to an embodiment.
Figure 10:
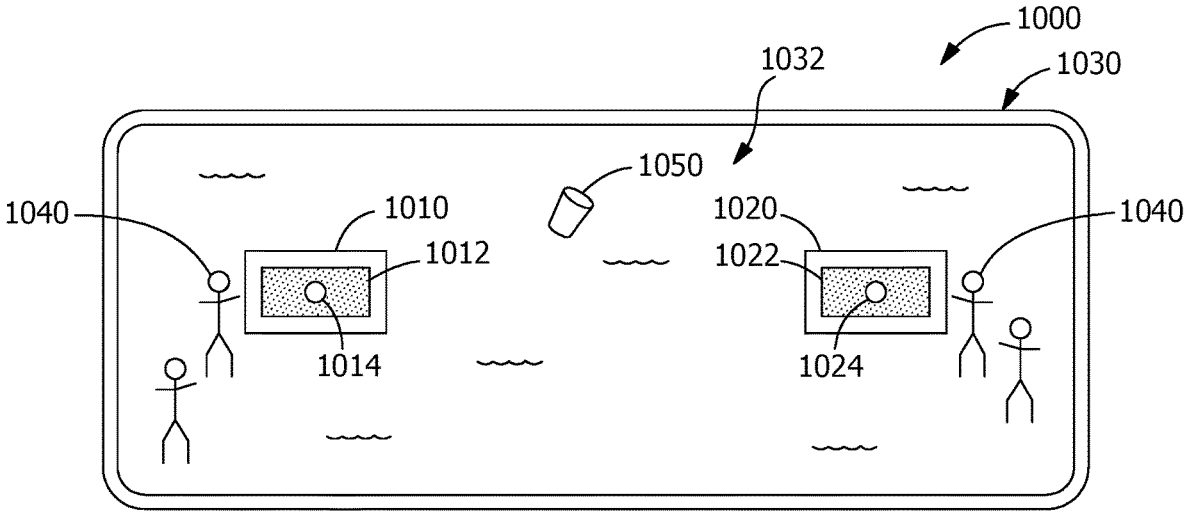
FIG. 10 is a diagram of the game being played, according to an embodiment.
Figure 11A:
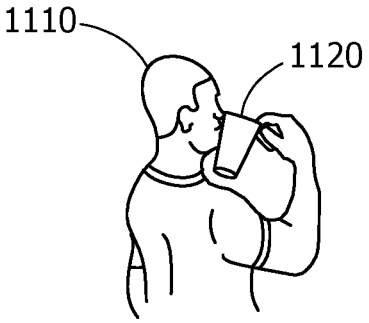
FIGS. 11A, 11B, 11C, and 11D illustrate the sequential step of tossing a cup, according to an embodiment.
Figure 11B:
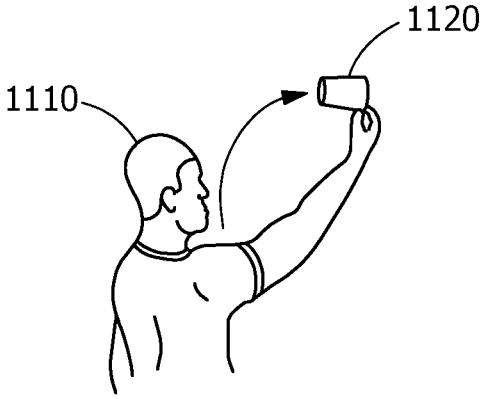
Figure 11C:
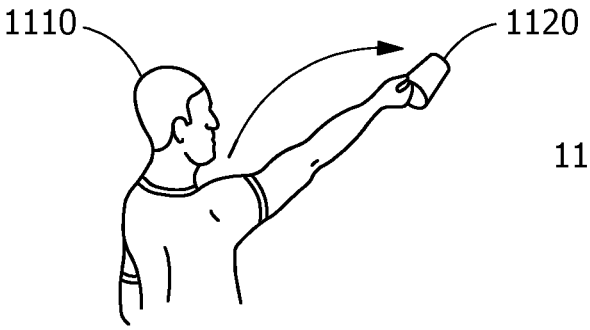
Figure 11D:
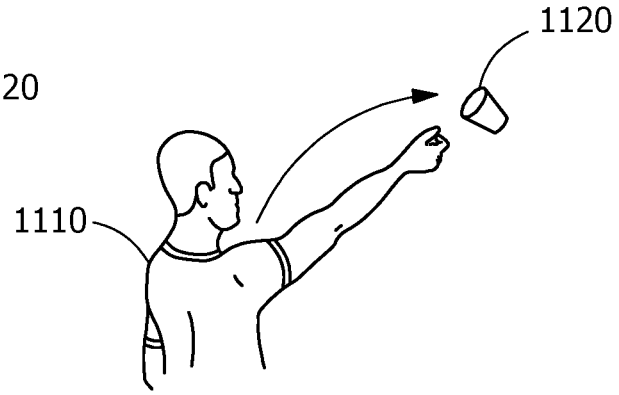

An embodiment of a second variation of playing the game using the insert 300 is described in FIG. 9, based on the diagram 1000 of FIG. 10. In this embodiment, a first goal 1010 includes an insert 1012 including an insert internal region 1014 and a second goal 1020 includes an insert 1022 further including an insert internal region 1024, in which the goals define the scoring sub-region via the smaller insert internal regions 1014, 1020. The first goal 1010 and second goal 1020 may be as described in the description of FIGS.

2 and 3 above, while the insert 1012, 1022 may be as described above with respect to FIGS. 4 and 5.

At block 920, a first participant 1040 adds a desired amount of water 1032 to a first cup 1050. At block 930, the first participant 1040 tosses the first cup 1050 into the air in the direction of the second goal 1020 attempting to cause the first cup 1050 to splash down within the scoring sub-region region defined by the second goal 1020.

At block 940, a third participant 1040 manipulates the second goal 1010 to adjust the position of the second goal 1020 during the cup's flight. In some embodiments, the rules require the position must be manipulated without lifting the goal from the surface of the water. The third participant 1040 may be a teammate of the first participant 1040. The third participant thus attempts to assist the first participant in causing the cup to fall within the insert internal region 1024. If the first participant 1040 is successful in causing the first cup 1050 to fall within the insert internal region 1024, the first participant 1040 and/or a first team scores, for example 1 point.

At block 950, a second participant 1040, typically of an opposing team, takes a turn by substantially repeating the steps of the first participant 1040. The second participant adds a desired amount of water 1032 to a second cup 1050. At block 950, the second participant 1040 tosses the second cup 1050 into the air in the direction of the second goal 1020 attempting to cause the second cup 1050 to splash down within the second goal 1020. At block 960, a fourth participant 1040 adjusts the position of the second goal 1020. The fourth participant 1040 may be a teammate of the second participant 1040. The fourth participant thus attempts to assist the second participant 1040 in causing the cup to fall within the scoring region of the insert internal region 1024.

If the second participant 1020 is successful in causing the second cup 1050 to fall within the insert internal region 1024 the second participant 1020 and/or the second team scores, for example 1 point. If the second cup 1050 lands within the first cup 1050, the second team has topped the first team and scores additional points, such as 1 additional point. If the first team still has a turn (i.e., at least one cup left to throw), the first team may attempt to top the second team's cup to earn two additional points (i.e., as many points as the number of cups stacked on top of one another).

The above steps of blocks 920 through 960 may be repeated until one participant/team has accumulated a predetermined number of points or a predetermined number of rounds have been played.

The game may also be played as a combination of the above described embodiments. For example, the game may be played in multiple stages in which the goals without inserts may be used for a predetermined number of rounds and the inserts may added to the goals for a predetermined number of rounds. The total points scored by each team can then be totaled and a victor determined.

An exemplary technique for tossing the cup of the game is shown is FIG. 11, although any suitable technique desired or preferred by a participant may be suitable. In the example of FIG. 11, a participant 1110 adds water (not shown) as described above to a cup 1120. The participant 1110 holds the cup 1120 by a lower portion of the lip of the cup 1120 and positions the cup 1120 with their arm bent in line with their arm (FIG. 11A). The participant 1110 then extends their arm with rotation of the wrist thus imparting forward motion and rotation to the cup 1120, as shown in FIGS. 11B-11D. As the cup 1120 rotates the centrifugal force generated allows some or all of the water to remain in the cup 1120. In some embodiments, when the cup 1120 is a conically shape cup 1120 as described above the mass distribution due to the water in combination with the conical shape is believed to stabilize the flight of the cup 1120 toward the goal in the game.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of playing a game comprising:

placing a goal in a body of water, the goal being constructed of a buoyant material, the goal having a flat upper surface, the goal comprising an outer frame having internal dimensions defining a frame internal region and a removable insert in the frame internal region of the outer frame, the removable insert having external dimensions corresponding to internal dimensions of the frame internal region, the removable insert having an insert internal region defining a scoring region; then adding, by a first participant, a first selected amount of water to a first cup having a lip defining a first open top; then holding by a lower portion of the lip and tossing, by the first participant, the first cup having the first open top and containing the first selected amount of water in the direction of the goal; then adding, by a second participant, a second selected amount of water to a second cup having a second open top; then tossing, by the second participant, the second cup having the second open top and containing the second selected amount of water in the direction of the goal; then repeating the steps of adding and tossing by each of the first and second participants; and awarding points in response to the first and second cups, respectively, being tossed into the scoring region.

2. The method of claim 1, wherein the body of water is a swimming pool.

3. The method of claim 1, further comprising placing the removable insert received by the outer frame to define the scoring region.

4. The method of claim 1, wherein the goal is not moved by any participant during the step of tossing.

5. The method of claim 1, wherein a third participant adjusts a position of the goal during the step of tossing by the first participant to assist the first participant in causing the cup to fall within the scoring region.

6. The method of claim 1, wherein a third participant adjusts the position of the goal during the step of tossing by the first participant without raising the goal from a surface of the body of water.

7. The method of claim 1, comprising placing at least two goals spaced apart in the body of water, wherein each goal is constructed of a buoyant material.

8. The method of claim 1, wherein the first and second cups have a container volume of between about 3 and about 24 fluid ounces.

9. The method of claim 1, wherein the cup is free of markings such that the first participant is unaided by markings when adding the selected amount of water to the first cup.

10. The method of claim 1, wherein the tossing by the first participant comprises holding the first cup by the lower portion of the lip of the cup, positioning the first cup with the first participant's arm bent in line with the first participant's arm, and extending the participant's arm with rotation of the participant's wrist, thus imparting forward motion and rotation to the first cup during flight.

11. A method of playing a game comprising:

placing a goal in a body of water, the goal being constructed of a buoyant material and having a frame defining a first scoring region; then adding, by a first participant, a first selected amount of water to a first cup having a first open top; then tossing, by the first participant, the first cup having the first open top and containing the selected amount of water in the direction of the first scoring region of the goal; then adding, by a second participant, a second selected amount of water to a second cup having a second open top; then tossing, by the second participant, the second cup having the second open top and containing the selected amount of water in the direction of the first scoring region of the goal; then awarding points in response to the first and second cups, respectively, being tossed into the first scoring region; then placing a removable insert in the frame defining the first scoring region, the removable insert having external dimensions corresponding to internal dimensions of the frame defining the first scoring region, the removable insert having an insert internal region defining a second scoring region smaller than the first scoring region; then adding, by the first participant, a third selected amount of water to the first cup; then tossing, by the first participant, the first cup containing the third selected amount of water in the direction of the second scoring region of the goal; then adding, by the second participant, a fourth selected amount of water to the second cup; then tossing, by the second participant, the second cup containing the fourth selected amount of water in the direction of the second scoring region of the goal; and then awarding points in response to the first and second cups, respectively, being tossed into the second scoring region.

* * * * *